United States Patent [19]

Huang et al.

[11] Patent Number: 5,021,293

[45] Date of Patent: Jun. 4, 1991

[54] COMPOSITE MATERIAL CONTAINING MICROWAVE SUSCEPTOR MATERIAL

[75] Inventors: Hua-Feng Huang, Mendenhall, Pa.; Donald E. Plorde, Midlothian, Va.

[73] Assignee: E. I. Du Pont de Nemours and Company, Wilmington, Del.

[21] Appl. No.: 398,995

[22] Filed: Aug. 28, 1989

Related U.S. Application Data

[63] Continuation of Ser. No. 2,980, Jan. 23, 1987, abandoned, which is a CIP of S.N. 06/832287, Feb. 21, 1986 and now abandoned.

[51] Int. Cl.[5] ..... B32B 15/04; B65D 85/00

[52] U.S. Cl. ..... 428/328; 428/34.3; 428/35.3; 428/35.8; 428/36.4; 428/212; 428/340; 428/402; 428/409; 428/458; 428/464; 428/480; 428/537.5; 426/107; 426/113; 426/127; 426/234; 426/241; 426/243; 427/205; 427/212; 427/419.1; 383/109; 383/116

[58] Field of Search ..... 428/328, 458, 34.3, 428/34.6, 34.7, 35.3, 35.8, 36.4, 212, 357, 402, 409, 464, 457, 689, 537.5, 480; 219/10.55 M, 10.55 E, 10.55 F; 426/107, 234, 241, 244, 243, 237, 110, 113, 127; 342/1, 2; 99/DIG. 14, 451; 206/591, 593, 594, 484; 383/105, 106, 109, 116, 122; 427/205, 212, 419.1

[56] References Cited

U.S. PATENT DOCUMENTS

| | | | |
|---|---|---|---|
| 2,923,934 | 2/1960 | Halpern | 343/18 |
| 2,951,246 | 8/1960 | Halpern et al. | 342/1 |
| 2,951,247 | 8/1960 | Halpern et al. | 343/18 |
| 3,007,160 | 10/1961 | Halpern | 343/18 |
| 3,234,038 | 2/1966 | Stephens et al. | 117/71 |
| 3,591,400 | 7/1971 | Palmquist et al. | 117/3.3 |
| 4,012,738 | 3/1977 | Wright | 342/1 |
| 4,125,319 | 11/1978 | Frank et al. | 350/362 |
| 4,190,757 | 2/1980 | Turpin et al. | 219/10.55 E |
| 4,230,924 | 10/1980 | Brastad et al. | 219/10.55 E |
| 4,266,108 | 5/1981 | Anderson et al. | 219/10.55 E |
| 4,267,420 | 5/1981 | Brastad | 219/10.55 E |
| 4,309,466 | 1/1982 | Stillman | 428/35 |
| 4,434,197 | 2/1984 | Petriello et al. | 427/407.1 |
| 4,450,334 | 5/1984 | Bowen et al. | 219/10.55 E |
| 4,492,730 | 1/1985 | Oishi et al. | 428/328 |
| 4,496,815 | 1/1985 | Jorgensen | 219/10.55 E |
| 4,501,790 | 2/1985 | Aizawa et al. | 428/283 |
| 4,518,651 | 5/1985 | Wolfe | 428/308.8 |
| 4,542,271 | 9/1985 | Tanonis et al. | 219/10.55 E |
| 4,623,565 | 11/1986 | Huybrechts | 428/324 |
| 4,641,005 | 2/1987 | Seiferth | 219/10.55 E |
| 4,684,577 | 8/1987 | Coq | 428/450 |
| 4,724,290 | 2/1988 | Campbell | 219/10.55 E |
| 4,731,294 | 3/1988 | Pouchol | 428/447 |

FOREIGN PATENT DOCUMENTS

| | | |
|---|---|---|
| 63108 | 10/1982 | European Pat. Off. . |
| 2046060A | 11/1980 | United Kingdom . |

*Primary Examiner*—Ellis P. Robinson
*Assistant Examiner*—Donald J. Loney

[57] ABSTRACT

A composite material useful for controlled generation of heat by absorption of microwave energy is disclosed. The material comprises a dielectric substrate, e.g., polyethylene terephthalate film, coated with a mixture of an electrically conductive metal or metal alloy in flake form in a thermoplastic dielectric matrix, e.g., a polyester copolymer. In a preferred embodiment, the coating of flake/thermoplastic is applied so as to yield an isotropic coating with good heating performance reproducibility. The use of circular flakes with flat surfaces and smooth edges contributes substantially to good heating performance reproducibility.

29 Claims, 3 Drawing Sheets

COMPOSITE MATERIAL CONTAINING MICROWAVE SUSCEPTOR MATERIAL

This application is a continuation, of U.S. application Ser. No. 07/002,980 filed Jan. 23, 1987, now abandoned and a continuation-in-part of copending U.S. application Ser. No. 832,287, filed Feb. 21, 1986.

BACKGROUND OF THE INVENTION

This invention relates to novel composites useful for controlled generation of heat by absorption of microwave energy.

Food preparation and cooking by means of microwave energy has, in recent years, become widely practiced as convenient and energy efficient. Along with the growth in the use of microwave cooking has been a growth in the sale and use of foods specially packaged for microwave cooking. Such special microwaveable packages attempt to alleviate some of the problems inherent in microwave cooking, for example, lack of browning or crispening of the surface of a cooked food item or uneven cooking due to development of "hot spots" in the food item. Examples of packaging materials developed for use in microwave cooking are those disclosed in U.S. Pat. Nos. 4,518,651, 4,267,420, 4,434,197, 4,190,757, 4,706,108, UK Patent Application No. 2,046,060A and European Patent Application Publication No. 63,108.

U.S. 4,518,651 to Wolfe discloses composite materials exhibiting controlled absorption of microwave energy based on the presence of electrically conductive particles such as particulate carbon in a polymeric matrix bound to a porous substrate. The resulting composite materials are to have a surface resistivity of 100 to 1000 ohms per square. Wolfe teaches that it is critical that at least some of the polymeric matrix be beneath the surface of the substrate, be substantially free of electrically conductive particles and be intermingled with the substrate. This is achieved by a lamination process at certain temperatures and pressures.

U.S. 4,267,420 to Brastad discloses a packaging material which is a plastic film or other dielectric substrate having a thin semiconducting coating. The semiconducting coating generally has a surface resistance of 1 to 300 ohms per square, and the preferred coating is evaporated aluminum. Similar materials, i.e., films with a continuous layer of electrically conductive material deposited thereon, are also disclosed in UK Patent Application 2,046,060A.

U.S. 4,434,197 to Petriello et al. discloses a multilayer structure having five layers including outside layers of polytetrafluoroethylene, two intermediate layers of pigmented polytetrafluoroethylene and a central layer of polytetrafluoroethylene containing an energy absorber. The energy absorber can be a material such as colloidal graphite, ferric oxide and carbon and should have a particle size such that it will uniformly disperse with particles of polytetrafluoroethylene to form a co-dispersion.

U.S. 4,190,757 to Turpin et al. discloses a microwaveable package composed of a non-lossy dielectric sheet material defining a container body and a lossy microwave absorptive heating body connected thereto, the heating body possibly comprising a multiplicity of particles of microwave absorptive material of different particle sizes and a binder bonding those particles together. Absorptive materials include zinc oxide, germanium oxide, iron oxide, alloys such as one of manganese, aluminum and copper, oxides, carbon and graphite. The binders for these materials are ceramic type materials such as cement, plaster of paris or sodium silicate, and the resulting materials are therefore not flexible. The package also requires a shield, for example, a metal foil sheet adapted to reduce by a controlled amount the direct transmission of microwave energy into the food product. A somewhat similar disclosure is found in U.S. 4,266,108 to Anderson et al. This patent also discloses a microwave heating device comprising a microwave reflective member positioned adjacent to a magnetic microwave absorbing material.

European Patent Application Publication No. 63,108 discloses a packaging material such that at least a region of one side thereof is provided with a coating comprising heat reflecting particles in a predetermined pattern, in for instance flake or particle shape. The heat reflecting particles preferably consist of metal particles of aluminum or another food-stuff inert metal and are preferably included within a layer of polyester, polymethylpentene or another material having corresponding heat resistance characteristics. The content of heat reflecting particles amounts to 0.01–1% by weight of the surface weight of the coating, and the heat resistant layer has a surface weight of 15 to 30 grams per square meter.

Despite the many developments to date in the field of microwaveable packaging, certain needs still exist. Many existing materials function in one way or another to convert a portion of the microwave energy into heat, but the materials offer little control to the packager in terms of how much heat is generated and how quickly. For example, some of the materials tend to heat uncontrollably in a microwave oven, leading to charring or even arcing, ignition and burning of the packaging material. Other available materials are simply not capable of generating enough heat quickly enough to be of use in certain applications (e.g., providing fast heat-up and high bag temperatures to provide efficient popping of popcorn in a microwave oven). And many of the available materials are simply not suitable for the mass disposable-packaging market because they are simply too expensive to produce.

SUMMARY OF THE INVENTION

New packaging materials for microwave use have now been found which solve some of the problems inherent in prior art materials. Specifically, this invention relates to composite materials for controlled generation of heat by absorption of microwave energy comprising (a) a dielectric substrate substantially transparent to microwave radiation and (b) at least one coating on at least one surface of the substrate, the coating comprising (i) about 5 to 80% by weight of a susceptor material in flake form capable of converting microwave energy to heat, and (ii) about 95 to 20% by weight of a thermoplastic dielectric matrix, wherein the surface weight of said coating on the substrate is in the range of about 2.5 to 100 g/m$^2$. The D.C. surface resistance of the resulting composite material is generally at least $1\times10^6$ ohms per square. These new materials offer the advantages of being economical to produce and of being easily adaptable so as to match the degree of heat generated to the requirements of the food which is packaged in it. The materials can be adapted to heat to very high temperatures within a very short time and thus find utility as packaging materials for food items for which browning is desired but which are cooked for relatively short periods of time (e.g., breadstuffs or pizza) and also for food items for which high temperatures and rapid heat-up are needed to insure efficient microwave cooking (e.g., popcorn).

Despite the high degree of heat which these materials are capable of generating, the amount of susceptor material and thermoplastic matrix can be adapted to avoid charring, arcing or burning of the packaging materials as often results from use of prior art materials.

DETAILED DESCRIPTION OF THE INVENTION

Figure 1:
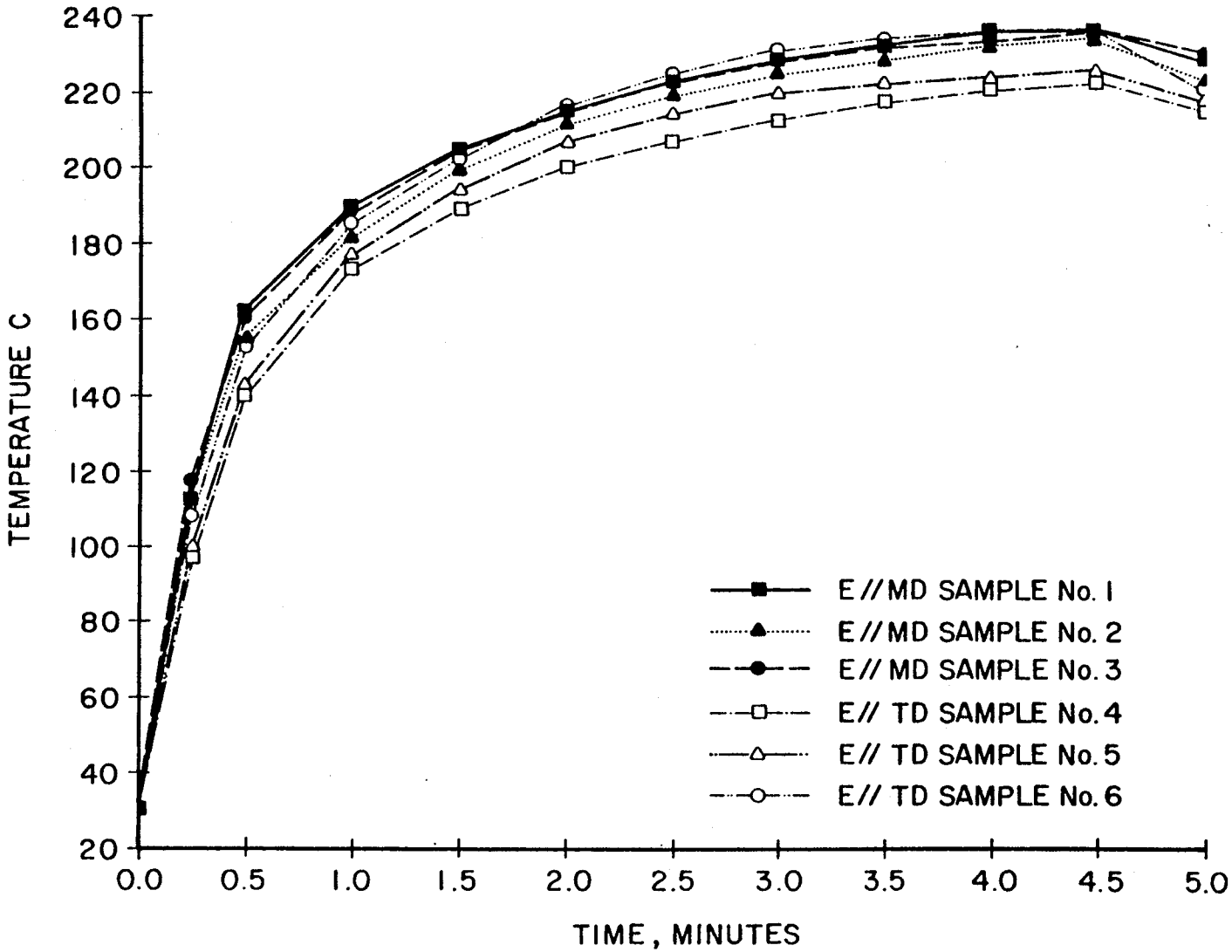

The substrate material used in this invention is a carrier web or film which has sufficient thermal and dimensional stability to be useful as a packaging material at the high temperatures which may be desired for browning or rapidly heating foods in a microwave oven (generally, as high as 150 degrees C. and above, preferably 220 degrees C. and above.) Polymeric films, including polyester films such as polyethylene terephthalate films and polymethylpentene films, and films of other thermally stable polymers such as polyarylates, polyamides, polycarbonates, polyetherimides, polyimides and the like can be used. Porous structures such as paper or non-woven materials can also be used as substrates so long as the required thermal and dimensional stability is satisfied. For flexible packaging, the substrate is preferably about 8 to 50 micrometers thick. Thicker, non-flexible materials, such as found in trays, lidding, bowls and the like, could also be used. The preferred substrate is biaxially oriented polyethylene terephthalate which is preferably about 12 micrometers thick.

As previously indicated, the substrate must have sufficient dimensional stability at the elevated temperatures involved in microwave cooking to prevent distortion of the substrate which may result in non-uniform cooking from loss of intimate contact of the packaging material with the food to be cooked. Substrates lacking such high temperature dimensional stability can be used if they are laminated with yet another substrate layer meeting the thermal stability requirements of the original substrate. The lamination can be accomplished either by taking advantage of the adhesive properties of the thermoplastic matrix coating on the original substrate or by using any number of conventional adhesives to aid in forming a stable laminate. For example, a composite of this invention such as a polyester copolymer coated polyethylene terephthalate film can be thermally sealed to another polyester film or to paper or heavier ovenable paperboard. Alternatively, another adhesive can be applied from solution prior to lamination to increase the strength of the laminate. These supplemental adhesives can be selected from a number of commercially available candidates with required thermal stability. These include copolyesters, copolyester-polyurethanes and cyanoacrylates.

The thermoplastic dielectric matrix used in the composite of this invention can be made from a variety of polymeric materials with sufficient thermal stability to allow for dimensional integrity of the final packaging material at the elevated temperatures associated with microwave cooking of food. The dielectric properties at 915 megahertz and 2450 megahertz of the matrix is also an important variable in terms of the heat generated in unit time at 2450 MHz. The dielectric matrix has a relative dielectric constant of about 2.0 to 10 with a preferred value of 2.1 to 5.0, and a relative dielectric loss index of about 0.001 to 2.5, preferably 0.01 to 0.6. The matrix also preferably displays adhesive characteristics to the substrate in the composite and any additional substrate to which the composite may be laminated to increase dimensional stability. For best results, the peel strength of the matrix to substrate(s) seal should be at least 400 to 600 g/in. A variety of polymeric materials known in the art meet these requirements. Examples include but are not limited to: polyesters, polyester copolymers, curable resins such as copolyester-polyurethanes and epoxy resins, polycarbonates, polyethersulfones, polyarylsulfones, polyamide-imides, polyimides, polyetheretherketones, poly 4,4-isopropylidene diphenylene carbonate, imidazoles, oxazoles, and thiazoles. These materials may be crystalline or amorphous. The preferred matrix is a polyester copolymer. These are reaction products of a glycol and a dibasic acid. Suitable glycols include ethylene glycol, neopentyol, mixtures of 1,4-butane diol, diethylene glycol, glycerin, trimethylethanediol and trimethylpropanediol. Suitable dibasic acids include azelaic, sebacic, adipic, iso-, tere- and ortho-phthalic, and dodecanoic acids. The preferred polyester copolymer is a copolymer or mixture of copolymers, of ethylene glycol with terephthalic and azealic acid or with terephthalic and isophthalic acid.

The susceptor materials used in this invention are metals and metal alloys which are capable of absorbing the electric or magnetic portion of the microwave field energy to convert that energy to heat. Suitable such materials include nickel, antimony, copper, molybdenum, bronze, iron, chromium, tin, zinc, silver, gold, and the preferred material, aluminum. Other conductive materials such as graphite and semiconductive materials such as silicon carbides and magnetic material such as metal oxides, if available in flake form, may also be operable susceptor materials and are deemed equivalent to the susceptor materials claimed herein.

The susceptor material must be in flake form. For the purpose of this invention, a particle is in flake form if its aspect ratio, defined as the ratio of the largest dimension of its face to its thickness is at least about 10. Generally speaking, the conductive materials useful as susceptors in this invention will have an aspect ratio in the range of 10 to 300. The preferred aluminum materials will generally have an aspect ratio in the range of 20 to 200. Those preferred aluminum materials also generally have a largest dimension of 1 to 48 micrometers and a thickness of 0.1 to 0.5 micrometers.

As variables, the amount and the physical size, shape and surface characteristics of the susceptor flakes used in the coating and the amount of that coating applied to the substrate depend on the type and portion size of the food to be cooked. It is by altering these variables that one may control the generation of heat exhibited by the material when it is used in a microwave oven. An advantage of the composites of this invention is that they can be tailored to heat to high temperatures in relatively short periods of time in conventional microwave ovens, e.g., to temperatures of about 150° C. or above, preferably 190° C. or above, in 120 seconds when subjected to microwave energy of 550 watts at 2450 megahertz.

The susceptor level in the thermoplastic matrix will generally range from about 5 to 80% by weight of the combined susceptor/matrix. The optimum level will vary according to the particular susceptor material selected, its size and shape. It has been found that for aluminum flakes, the preferred amount is 20 to 70 weight % of the susceptor/matrix. The amount of susceptor/matrix applied to the substrate will generally range from about 2.5 to as high as 100 g/m$^2$. This will lead to a dry coating thickness in the range of as low as 1 to as high as 75 micrometers. The amount of susceptor/ matrix coating used will, of course, vary with the end use of the packaging material. For applications where browning and crispening of a food product is desired, e.g., cooking pizza, the amount of coating might be 50 to 75 g/m$^2$. For other applications where high temperatures and rapid heat-up are desired, e.g., cooking popcorn, the amount might be 2.5 to 15 g/m$^2$.

The composite of this invention can be made by a number of methods. In one method, the dielectric matrix is dissolved in any number of common organic solvents such as tetrahydrofuran, methylene chloride, ethyl acetate, methyl ethyl ketone or similar solvents, and then the susceptor is dispersed in this solution. The solution is then applied to the carrier film or web by any number of coating processes such as metered doctor roll coating, gravure coating, reverse roll coating or slot die coating. The solvent is driven off after application of the coating by conventional oven drying techniques. A second technique is useful for melt stable matrices. The matrix material is melted in conventional equipment and the susceptor particles blended with the melt. This mixture is then extrusion or melt coated on the film or web substrate. In either case, the application of the susceptor/matrix is a well controlled process that can be readily altered to vary the temperature range of the composite material when used in a microwave oven. This control is superior to that used in prior art vacuum metallizing processes and the coating process can operate at much higher speeds since no vacuum is required. Conceptually, the susceptor/matrix can be applied in patterns that would allow a variety of temperature properties in a single sheet of composite material.

Ideally, packaging materials of the type disclosed herein should have reproducible heating performance. A consumer should be able to rely on a specific material heating to a specific temperature range within a specific time frame whenever exposed to microwave radiation in his microwave oven. In the absence of such reproducible heating performance, a packaging material would lack wide commercial utility.

To achieve heating performance reproducibility, it has been found that the susceptor coating should be uniform and isotropic. The term isotropic as used herein means that the composite with the susceptor/matrix coating will exhibit substantially the same properties (i.e., heat to substantially the same temperature) when exposed to the electric field component of microwave radiation in any direction. Tests indicate that an oblong flake of susceptor material capable of coupling with the electric field, for example, will couple better when the incident electric field is parallel to the flake's largest dimension. Therefore, the heat generated from an oblong flake will vary from a maximum when the incident electric field is parallel to the largest dimension to a minimum when the incident electric field is perpendicular to the largest dimension. If the susceptor/matrix coating is isotropic, then, regardless of the fact that the susceptor material is an oblong flake, the degree of coupling of the susceptor material with the incident electric field, and, thus, the heat generated from the susceptor coating, will not vary substantially with the direction of the incident electric field.

(For simplicity, this discussion is limited to susceptors which couple with the electric portion of the microwave field energy. Susceptors which couple with the magnetic portion of the microwave field energy are deemed to be equivalent, and the principles disclosed herein apply equally to the incident magnetic field in such cases.)

A substantially isotropic coating can be achieved using oblong flakes of susceptor materials if at least two coating layers are provided, the direction of alignment of the flakes (i.e., the direction of the longest surface dimension of the flakes) in one layer being oriented at about ninety degrees to the direction of alignment of flakes in the second layer. To illustrate, when a coating of oblong flake susceptor/matrix is applied to the substrate, the flakes tend to be aligned lengthwise in one direction, e.g., the direction in which the coating was stroked onto the substrate. To achieve an isotropic coating, a second layer of coating is stroked on in a direction perpendicular to the direction in which the first layer was applied. Multiple successive cross-passes of coating may be applied in this manner. One possible way in which the multiple layers of coating may be applied to achieve isotropy is by 45 degree opposing gravure printing.

The preferred way to achieve a substantially isotropic coating is to use circular flakes of susceptor material. These flakes tend to be flatter and have smoother edges than other commercially available flakes and are substantially round; it is believed that their ellipticity (ratio of largest to smallest surface dimensions) is in the range of about 1:1 to 1:2, preferably about 1:1 to 1:1.5. This is in contrast to other commercially available aluminum flakes which are oblong, and generally have ellipticities greater than 1:2, sometimes as high as 1:4. Circular aluminum flakes are available commercially from Kansai Paint Company, Hiratsuka, Japan, under the designations "Aluminum Y" and "Aluminum X". Circular flakes will provide an isotropic coating so long as they are applied so as to be parallel to the film surface and in a manner which avoids fragmentation of the flakes which can lead not only to irregularly shaped flakes but also to their random agglomeration.

To achieve best results, the manner in which the susceptor/matrix is applied to the substrate has been found to be important. First, it has been found that the susceptor/matrix should be applied to the substrate in such a way that the plane of the large dimension of the flake is substantially parallel to the surface of the substrate. Second, the flakes should be dispersed in the thermoplastic matrix so that they are substantially insulated from each other.

A number of factors can be controlled to achieve these goals. The selection of the flake susceptor material can greatly affect the ability to achieve a uniform and isotropic coating with properly aligned flakes. Our work indicates that the smoother and flatter the flakes are, the easier they will be to disperse in the thermoplastic matrix, thus reducing agglomeration. The smaller the aspect ratio (largest dimension to thickness) of the flakes, the less mechanical damage the flakes will encounter during the coating process and, thus, the less fragmented debris, capable of agglomerating, will result. The circular flakes described above have many of these desired features, e.g., smooth edges, flat surfaces and low aspect ratio.

Apart from the selection of the flake susceptor itself, the manner in which the susceptor coating is applied to the substrate plays a major role in achieving the flake orientation that will lead to heating performance reproducibility. While the susceptor thermoplastic matrix coating can be applied in a single coating layer, it has been found that the desired flake orientation can more easily be achieved by application of a plurality of thin, dilute coats of the material Each coating layer is applied from a dilute (e.g., about 15–35% total solids) dispersion of susceptor and matrix in solvent. The ideal amount of susceptor in the coating layers varies according to the susceptor material selected. Generally, it has been found that good results are achieved when coatings are used in which circular aluminum flakes comprise about 40–70% of the total solids (susceptor and thermoplastic matrix), or in which oblong aluminum flakes comprise about 20–60% of the total solids, or in which non-aluminum flakes comprise about 10–40% of the total solids.

The susceptor/matrix coating can be applied in a single coating layer if coating methods which insure laminar flow are utilized, e.g., slot coating with a small gap and a long land length. When only a single coating layer is to be applied, a high solids dispersion of the susceptor/matrix should be used, and the amount of susceptor in the solids should also be high.

As previously mentioned, a uniform and isotropic susceptor/matrix coating is desired because the heating performance of a composite so coated will have superior reproducibility. For the purpose of measuring and quantifying heating performance reproduciblity, the following test can be used.

TEST FOR HEATING PERFORMANCE REPRODUCIBILITY

Six 1-cm by 2-cm pieces taken from a sample composite are heated in a 2450 MHz microwave electric field of 243 V/cm. (This simulates the hot spot electric field in a typical 700 watt microwave oven.) The samples are divided into two groups. Samples in Group 1 are oriented so that the electric field is parallel to the longitudinal or machine direction (MD) of the sample, and samples in Group 2 are oriented so that the electric field is parallel to the cross or transverse direction (TD) of the sample. The temperature of each composite sample is measured after exposure to the microwave electric field for four minutes. The mean temperatures for each group of samples as well as for all six samples taken as a whole are determined. With this test, the sample composite is deemed to possess heating performance reproducibility if:

(1) $\overline{MD}$ and $\overline{TD}$ are each within $\overline{Temp}\pm5\%$, (2) Each MD temperature is within $\overline{MD}\pm10\%$, and (3) Each TD temperature is within $\overline{TD}\pm10\%$;

where $\overline{MD}$ is the mean temperature for the samples of Group 1, $\overline{TD}$ is the mean temperature for the samples of Group 2, $\overline{Temp}$ is the mean temperature for all six samples, MD temperature is the temperature for any sample in Group 1, and TD temperature is the temperature for any sample in Group 2, all temperatures being in degrees Centigrade.

A non-resonant 2450 MHz waveguide system, such as described below, can be used to obtain the data required for the Heating Performance Reproducibility Test. The system comprises a microwave generator feeding 254 watts through a microwave-circulator into a section of WR284 rectangular waveguide terminated with a shorting plate. (WR284 is a rectangular waveguide with an interior cross-section of 7.2 cm. by 3.4 cm.) The reflected wave from the short circuit establishes a V/cm pure electric field at the standing wave maxima in the waveguide section as long as the sample perturbation is small and the reflected energy is dissipated by the matched termination connected to the third port of the microwave circulator before it can make a third pass through the sample assembly. The microwave heating of the 1-cm by 2-cm sample is measured by recording the temperature reading of a Luxtron Fluoroptic temperature probe which was sandwiched between the 1-cm by 2-cm film sample and a 5 millimeter diamater Teflon (R) polytetrafluoroethylene (E.I. du Pont de Nemours and Co., Wilmington, Delaware) rod. The probe-film assembly is secured to the rod by a Teflon (R) polytetrafluoroethylene tape. The whole tape-film-probe-rod assembly is inserted through an aperture into the sample holder position in the waveguide, located at a distance of (n/4)(23.1 cm), where n is an odd integer, from the end of the end shorting plate. (23.1 cm is the full wavelength.) A waveguide phase shifter and an electric field probe is used to shift the electric field maximum to the sample position. The temperature versus time heating profile was recorded for each sample piece over a period of at least four minutes.

The composite materials of this invention are further illustrated by the following examples. In each of these examples, the surface D.C. resistances of the exemplified composite materials are greater than $1\times106$ ohms per square. D.C. surface resistances can be measured by methods known in the art (e.g., ASTM D257-78) using conventional, commercially available instruments. All temperatures are in degrees Centigrade.

The samples prepared in Examples 1–8 and Comparative Example A were tested in a commercial microwave appliance rated at 550 watts at a frequency of 2450 megahertz. Tests in the microwave oven of the invention were run both in the presence and absence of food. Two types of temperature monitors were used. One was a single optical pyrometer probe used with a Vanzetti Optical Pyrometer. This is a non-contact probe which is dependent on the emmissivity of the article whose temperature is being measured. The second temperature monitor used was a Luxtron Fluoroptic four channel device with contact thermo probes. Temperature measurements made in the absence of food were carried out by suspending a two-inch square of test material (either the coated film or the coated film laminated to paper or paperboard) in the microwave oven in generally the geometric center of the cavity. The test item is attached to the Luxtron thermo probe and to a string which enters the cavity from a hole drilled through the exterior cabinet and into the interior cavity. The string itself is the suspending agent with the test item attached to it with a piece of non-lossy adhesive tape. Temperature is recorded at fifteen second intervals over the course of 3 minutes and 15 seconds. The oven is cooled to room temperature between tests.

EXAMPLES

Example 1

This example shows the heat generating capabilities of the combined metal flake/dielectric matrix with support film compared to the support film itself or the support film coated with the dielectric matrix but in the absence of the metal flake.

The matrix coating was prepared in the following manner. The matrix polymer, in this case 15.8 weight parts of the copolymer condensation product of 1.0 mol of ethylene glycol with 0.53 mol of terephthalic acid and 0.47 mol of azelaic acid, was combined with 0.5 weight parts of erucamide and 58 weight parts of tetrahydrofuran in a heated glass reactor vessel equipped with paddle stirrer. After dissolution of the solids at 55° C., 0.5 weight parts of magnesium silicate and 25 weight parts of toluene were blended in. Finally 35 weight parts of dry aluminum flake (Alcoa Aluminite flake, grade 1663) was blended in. These flakes have a diameter distribution of 1 to 48 micrometers (88% in the 4 to 24 micrometer range), a thickness in the 0.1 to 0.5 micrometer range, and a surface area in the range of 1 to 15 $m^2$/gram.

A second matrix coating was prepared in the same fashion as that above except that no aluminum flake was added. Each of these coating dispersions were cast, in separate experiments, on 12 micrometer thickness, biaxially oriented polyethylene terephthalate film to a wet coating thickness of 230 micrometers. The wet coated films were allowed to dry. The dry coating weight of the dispersion containing aluminum flake was 54 grams per square meter with the aluminum comprising 67% by weight of the dried coating. In the second coating dispersion without aluminum flake added, the dried coating weight was 19 grams per square meter. Coating weight is determined by stripping the film of the dried coating and gravimetrically determining unit weight of coated and stripped film. In these two cases the amount of copolymer matrix is approximately equal.

Samples of each coated film and an uncoated piece of the carrier film detailed above were cut to two-inch squares. Temperature measurements were carried out in the microwave oven as described earlier. Results of the heating test are set out below in Table I.

TABLE I

| Sample | Temp. (°C.) after microwave exposure for - 30 sec. | 60 sec. | 90 sec. | 195 sec. | Total Coating Weight $g/m^2$ | Wet Coating Thickness (micrometers) | Weight Thermoplastic Matrix ($g/m^2$) |
|---|---|---|---|---|---|---|---|
| Uncoated carrier film | 56 | 65 | 68 | 77 | — | — | — |
| Coated film without Aluminum Flake | 58 | 65 | 70 | 78 | 19 | 230 | 19 |
| Coated film with Aluminum Flake | 190 | 213 | 87* | — | 54 | 230 | 18** |

*Film has melted.
**Thermoplastic matrix comprises 33% by weight of dry coating.

Example 2

This example shows the effect of the amount of aluminum flake on a weight basis in the dried coating on the temperature reached by the composite of the aluminum/matrix coating on carrier film. This example also shows the effect of the total aluminum/matrix unit weight on the carrier film on the temperature generated.

Dispersions of aluminum flake in the matrix binder dispersion were made in the same fashion from the same materials as given in Example 1. In three separate experiments the coating dispersion without aluminum flake was prepared as in Example 1. To one dispersion 1.1 weight parts of aluminum flake was added. Likewise 5.6 weight parts of aluminum flake was added to the second dispersion and 11.2 weight parts to the third dispersion. Each of these dispersions were used to prepare coated film on 12 mil biaxially oriented polyethylene terephthalate as described in Example 1. Wet coating thicknesses at 100, 150 and 200 micrometers were cast with coating knives from each of the aluminum flake dispersions above. Coated samples were allowed to dry. Each of the dispersions will give, on a dry solids basis, 10, 25 and 40 weight percent aluminum flake, respectively.

Temperature measurements were carried out in the microwave oven as described in earlier. Results of these heating tests are set out below in Table II.

TABLE II

| Weight % Al/Coating Weight $g/m^2$ | Wet Coating Thickness, mm | Temp. (°C.) after microwave exposure for - 60 sec. | 120 sec. | 195 sec. |
|---|---|---|---|---|
| **10/6 | 100 | 75 | 78 | 81 |
| **10/12 | 150 | 70 | 75 | 80 |
| **10/17 | 200 | 79 | 85 | 89 |
| 25/5 | 100 | 75 | 80 | 84 |
| 25/16 | 150 | 89 | 91 | 94 |
| 25/21 | 200 | 109 | 119 | 127 |
| 40/9 | 100 | 114 | 126 | 133 |
| 40/20 | 150 | 166 | 180 | 194a |
| 40/25 | 200 | 181 | 191 | 201a |

a-Film shrinks
*Weight % Al. dry basis based on total Al/thermoplastic matrix
**Comparative examples

Example 3

This example shows that aluminum flake as a high solids paste in mineral spirits or high flash naptha, in the presence or absence of leafing agents, can be substituted for the dry aluminum flake used in Example 1 and 2.

Copolymer matrix dispersions were prepared as described in Example 1. Successive aluminum flake coating dispersions were made substantially as described in Example 1. In Test A 52.5 weight parts aluminum paste (Alcoa leafing paste grade 6205, 65 weight % non-volatiles in Rule 66 mineral spirits) was used. In Test B 52.1 weight parts of aluminum paste (Alcoa leafing paste grade HF905, 65.5 weight % non-volatiles in high flash naptha) was used. In Test C 52.1 weight parts aluminum paste (Alcoa non-leafing paste grade HF925, 65.5 weight % non-volatiles in high flash naptha) was used.

The above aluminum dispersions were used in coating of 12 micrometer thick biaxially oriented polyethylene terephthalate using a coating knife to give a wet coating thickness of 230 micrometers as described in Example 1.

Heating tests on the dried films were carried out in the microwave oven as described earlier with the results set forth below in Table III.

TABLE III

| Test | Coating Wt. g/m² | Temperature (°C.) after microwave exposure for - 15 sec. | 30 sec. | 45 sec. | 120 sec. |
|---|---|---|---|---|---|
| A | 31 | 151 | 149 | 146 | 156a |
| B | 54 | 163 | b | — | — |
| C | 47 | 161 | 196 | 221 | 52c |

a-Film ignited
b-Film arced and melted at 19 seconds
c-Film melted

Example 4

This example illustrates that aluminum flake with different surface area, as expressed in covering range in square centimeters per gram of flake, can be substituted for that given in the first example.

Dispersions of the matrix copolymer were prepared as described in Example 1. Successive dispersions were then prepared as described in Example 1 using aluminum flake with differing covering power. Test A employed the very same dispersion as described in Example 1 using 35 weight parts of the Alcoa dedusted Aluminite flake grade 1663 with a covering range of 20,000 square centimeters per gram. Test B employed 34.1 weight parts of aluminum flake (Alcoa dedusted Aluminite flake grade 1651 with a covering range of 12,000 square centimeters per gram). Test C employed 47.7 weight parts of aluminum paste (Alcoa leafing paste grade 6678, 71.5 weight % non-volatiles in Rule 66 mineral spirits and a covering range of 28,000 to 30,000 square centimeters per gram) was used.

These aluminum flake dispersions were cast on 12 micrometer thick biaxially oriented polyethylene terephthalate film with a coating knife to give a 230 micrometer wet coating thickness as described in Example 1.

The dried films were tested in the microwave oven as described earlier and the results are set forth below in Table IV.

TABLE IV

| Test | Dry Coating Wt. g/m² | Temp. (°C.) after microwave exposure for - 30 sec. | 45 sec. | 195 sec. |
|---|---|---|---|---|
| A | 54 | 213 | 87a | |
| B | 61 | b | | |
| C | 84 | 153 | 172 | 67a |

a-Film melted
b-Ignited in 7 seconds

Example 5

This example will illustrate the substitution of a higher softening point matrix copolymer for the copolymer described in Example 1.

A dispersion of the same copolymer was prepared as described in Example 1 with the addition of 1.8 weight parts of a copolymer made by reacting 1.0 mol of ethylene glycol with 0.55 mol of terephthalic acid and 0.45 mol of isophthalic acid. To this mixed copolymer dispersion is added 5.6 weight parts of aluminum flake (Alcoa dedusted Aluminite flake grade 1663) as described in Example I.

This coating dispersion is cast on 12 micrometer biaxially oriented ethylene terephthalate film using a coating knife to achieve a 200 micrometer wet coating thickness as described in Example 1.

Testing of a dried example of this coated film is carried out in a microwave oven as described earlier. For comparison, a coated film sample with nearly the same aluminum content, on a dry basis, as prepared in Example 2 was tested. The results are presented in Table V.

TABLE V

| Copolymer | Weight % Al/Dry Coating Wt. | Temp. (°C.) after microwave exposure for - 60 sec. | 120 sec. | 195 sec. |
|---|---|---|---|---|
| Single (Example 2) | 25/21 g/m² | 109 | 119 | 127 |
| Mixed (Example 5) | 23/27 g/m² | 118 | 131 | 139 |

Example 6

This example illustrates the use of a secondary support web to promote dimensional stability of the primary structure of the invention as described in Example 1.

Samples of film coated with the aluminum flake/-polyester copolymer dispersion as described in Example 1 or 2 is treated with an adhesive solution on the uncoated side of said structure. The adhesive used was a solution of a moisture curable, isocyanate ended copolyester (Morton Chemicals Adcote 76FS93, 3 weight parts of the adhesive diluted with 8 weight parts of ethyl acetate as recommended by the manufacturer) and was applied by a typical laboratory aerosol spray device. The adhesive as applied was dried briefly with aid of a hot air gun and then a suitably sized piece of bleached white paper (160 micrometer thickness) applied with the aid of a rubber roller. The laminate was stored under a weighted glass plate for a minimum of 18 hours prior to use.

The laminates as described above were tested in a microwave oven as described earlier. In these tests the suspension string was attached to the paper side of the laminate and the fiber optic probe to the coated side of the film. The results of these tests are presented below in Table VI.

TABLE VI

| Test Sample | Weight % Al/Dry Coating Wt. | Wet Coating thickness* | Temp (°C.) after microwave exposure for - 60 sec. | 120 sec. | 195 sec. |
|---|---|---|---|---|---|
| Unlaminated (see Example 2) | 40/25 g/m² | 200 | 181 | 191 | 201a |
| Laminated | 40/25 g/m² | 200 | 167 | 178 | 180 |

a-Film shrinks
*micrometers

Example 7

This example and the following Example 8 will illustrate the utility of this invention in the preparation of foods in a microwave oven. These examples illustrate the range of heat generating capability of the articles of this invention in preparation of foods requiring additional heat to improve cooking food performance or to improve visual appearance or textural consistency of the cooked food. In this example, it will be shown that popping performance of commercial microwave popcorn packages can be improved by incorporation of the article of invention as part of the microwave popcorn package.

A laminate of the primary structure as described in Example 1 and a paper secondary support web as described in Example 6 are used. The primary structure before lamination consisted of 40 weight % of aluminum flake dispersed in the polyester copolymer matrix (dry solids basis) and applied to 12 micrometer thick biaxially oriented polyethylene terephthalate at a wet cast thickness such as to achieve a dry coating weight of 11 grams per square meter of which 3.6 grams per square meter was aluminum flake. The dry coating weight was determined by gravimetric techniques wherein a convenient sized piece of the coated film is soaked in tetrahydrofuran until the coating is stripped. After rinsing with additional tetrahydrofuran, the stripped support film is oven dried and weighed. The aluminum flake composition of the coating is readily determined on the coated film either directly by x-ray fluorescence techniques or by pre-digestion of a sample in strong mineral acid followed by determination of aluminum using standard atomic absorption techniques.

A commercial microwave popcorn bag paper made from a copolyester-coated polyethylene terephthalate laminate was altered for use in this test. A three by five inch rectangle of a laminate as described above was affixed to the bottom of the bag using a cyanoacrylate adhesive. The said piece was affixed with the coated side on the inside bottom of the bag and the paper side upward. A 100 gram plug of the combined popcorn and oil from a purchased bag of microwave popcorn was transferred to the bag with heater pad affixed. The 100 gram plug of popcorn and oil was found to contain 554 kernels of popcorn. The test bag was then sealed at its top opening using a bar sealer (at 125° C. and 35 kilopascals for one second).

The test bag and a control bag (commercial bag as described above) were then tested in the 550 watt microwave oven as described in Example 1. A fiber optic probe for the Luxtron Fluoroptic thermometer described in Example 1 was inserted in the exterior bottom flap of the package so that the sensor end was located below the approximate geometric center of the test pad and separated from it by just one layer of the bag. In these tests the bag (test or control) was raised from the metal floor of the interior cavity of the microwave oven with the use of an inverted paperboard tray 15 centimeters square by 3 centimeters in height (the tray is fabricated from unbleached, pressed, ovenable paperboard of 50 micrometer thickness).

The time for popping (3 minutes, 15 seconds) was within the range recommended on the commercial package. Once each bag had been popped, the bags were cooled and opened. The bag contents were poured into a graduated 2500 cubic centimeter beaker and its volume measured. The popped and unpopped kernels are then separated and a count made of the unpopped kernels from which the percentage of the unpopped kernels out of the total content was calculated. These results are set forth in Table VII.

TABLE VII

| Bag | Max. Temp. °C. at bag bottom | Pop Volume (Cubic Centimeters) | Count of Unpopped kernels | % Unpopped |
|---|---|---|---|---|
| Control | 236 | 1875 | 158 | 29 |
| Test | 257 | 2000 | 143 | 26 |

Example 8

In this example the utility of the invention in providing sufficient heat in a microwave oven to effect browning and crispening of microwave pizza is illustrated.

An article of this invention as described in Example 1 is used to prepare a tray for cooking of commercially available microwaveable pizza. In this example the primary structure consisted of a 12 micrometer thickness film of biaxially oriented polyethylene terephthalate to which was applied, according to the description to Example 1, a dispersion of aluminum flake (Alcoa dedusted Aluminite flake grade 1651) in the polyester copolymer binder solution as described in Examples 1 and 4, applied to a dry coating weight of 61 g/m$^2$. The aluminum flake content of the liquid matrix dispersion is 67 weight % on a dry solids basis and the wet coating thickness used was 230 micrometers. The coated side of the dried film was affixed to the top side of an inverted paperboard tray using a cyanoacrylate adhesive. The 20 centimeter square by 3 centimeter height tray was constructed of pressed ovenable paperboard with a thickness of 50 micrometers.

A commercial microwaveable pizza (255 gram cheese pizza) was removed from its freezer package and centered on the tray described above. The tray with pizza was then placed on the floor of the 550 watt microwave oven described in Example 1 and cooked for two minutes. The top of the pizza was bubbling hot with aesthetically pleasing appearance judged from cheese melted but retaining its shredded appearance. The bottom of the pizza crust immediately after removal from the microwave oven was dry to the touch and had no visible moisture. The bottom crust was browned with a few small areas beginning to show signs of charring which is the expected appearance of pizza crust. The crust was noticeably crisp when a knife was scraped across it and was definitely crisp when cut with the knife. A control pizza was cooked using the tray incorporated in a commercial package, a tray lined with lightly metallized polyethylene terephthalate film. It too gave satisfactory appearance of the top and crust but this was achieved only after the recommended cooking time of 3 minutes and 30 seconds.

Comparative Example

This example illustrates the importance of the flake structure for optimum performance in terms of temperatures generated.

A copolymer dispersion is prepared as described in Example 1 using 11.2 weight parts of powdered aluminum (less than 75 micrometer particle size). This dispersion is cast on 12 micrometer thick biaxially oriented polyethylene terephthalate film with a coating knife to achieve a wet coating thickness of 200 micrometers as described in Example 1.

The dried coated film was tested in a microwave oven as described earlier. The test results, and the results for a comparable film in which aluminum flake was used as the susceptor material (from Example 2) are set forth in Table A.

TABLE A

| Al | Weight % Al/Dry Coating Wt | Wet Coating thk., Micrometers | Temp (°C.) after microwave exposure for - 60 sec. | 120 sec. | 195 sec. |
|---|---|---|---|---|---|
| Pow- | 40/28 g/m$^2$ | 200 | 78 | 84 | 90 |

TABLE A-continued

| Al | Weight % Al/Dry Coating Wt | Wet Coating thk., Micrometers | Temp (°C.) after microwave exposure for - 60 sec. | 120 sec. | 195 sec. |
|---|---|---|---|---|---|
| dered Flake | 40/25 g/m² | 200 | 181 | 191 | 201a |

a-Film shrunk

Examples 9–27

Numerous film samples were prepared to investigate the factors important for providing reproducible heating performance. Each of the samples listed in Table VIII was prepared by hand-coating polyethylene terephthalate film with a doctor-knife type draw bar with a coating of aluminum flake in a polyester copolymer matrix as used in Example 1. The types of aluminum flake used were as follows:

C-1: circular flake, average diameter of 10 microns, "Aluminum X", available from Kansai Paint Company, Hiratsuka, Japan C-2: circular flake, average diameter of 20 microns, "Aluminum Y", available from Kansai Paint Company, Hiratsuka, Japan E-1: oblong flake, average diameter of 35 microns, "OBP-8410", available from Obron Corporation, Painesville, OH E-2 : oblong flake, average diameter of 2–5 microns, "L-875-AR", available from Silberline Manufacturing Company, Lansford, PA Circular flakes C-1 and C-2 were flatter and had smoother edges than oblong flakes E-1 and E-2.

Six 1-cm by 2-cm pieces taken from each coated film sample were heated in a microwave electric field of 243 V/cm, using the procedure described previously, three with the electric field parallel to the machine direction of the film, and the other three with the electric field parallel to the transverse direction of the film. (Films were hand coated in the machine direction of the film.) The temperature of the film was measured over a period of about five minutes. Mean temperature data are presented in Table VIII which also indicates whether the samples passed the Heating Performance Reproducibility Test set forth previously.

TABLE VIII

| Ex. | Flake Type | Wet Thickness (MIL)* | # of Coating Passes | % Al of Dry Coat |
|---|---|---|---|---|
| 9 | C-2 | 2 | 3 | 20 |
| 10 | C-2 | 6 | 1 | 20 |
| 11 | C-1 | 2 | 3 | 60 |
| 12 | C-2 | 6 | 1 | 60 |
| 13 | C-2 | 6 | 1 | 33 |
| 14 | C-1 | 6 | 1 | 20 |
| 15 | C-1 | 6 | 1 | 60 |
| 16 | E-2 | 2 | 3 | 33 |
| 17 | E-2 | 6 | 1 | 60 |
| 18 | C-1 | 6 | 1 | 33 |
| 19 | C-1 | 2 | 3 | 20 |
| 20 | E-2 | 2 | 3 | 60 |
| 21 | E-2 | 6 | 1 | 33 |
| 22 | E-1 | 6 | 1 | 60 |
| 23 | C-2 | 2 | 3 | 60 |
| 24 | C-2 | 2 | 3 | 33 |
| 25 | E-1 | 2 | 3 | 33 |
| 26 | C-1 | 2 | 3 | 33 |
| 27 | E-1 | 6 | 1 | 33 |

*Per layer of coating

TABLE VIII

| Ex. | 4' MD | 4' TD | 4' Temp | Passes Heating Performance Reproducibility Test? |
|---|---|---|---|---|
| 9 | 43.5 | 41.7 | 42.6 | Yes |
| 10 | 43.3 | 43.6 | 43.4 | Yes |
| 11 | 233.6 | 226.6 | 230.1 | Yes |
| 12 | 215.9 | 207.1 | 211.5 | Yes |
| 13 | 53.6 | 57.6 | 55.6 | Yes |
| 14 | 45.0 | 44.4 | 44.7 | No |
| 15 | 213.0 | 170.8 | 191.9 | No |
| 16 | 184.6 | 168.8 | 176.7 | No |
| 17 | 205.4 | 194.2 | 199.8 | No |
| 18 | 59.4 | 68.0 | 63.7 | No |
| 19 | 51.4 | 46.4 | 48.9 | No |
| 20* | 190.0 | 184.1 | 187.1 | No |
| 21 | 81.3 | 94.4 | 87.8 | No |
| 22 | 129.2 | 119.0 | 124.1 | No |
| 23 | 141.6 | 130.2 | 135.9 | No |
| 24 | 73.2 | 64.9 | 69.1 | No |
| 25 | 219.3 | 175.3 | 197.4 | No |
| 26 | 105.9 | 125.7 | 115.8 | No |
| 27 | 98.6 | 133.1 | 115.9 | No |

4' MD - Mean temperature of MD samples at 4 minutes
4' TD - Mean temperature of TD samples at 4 minutes
4' Temp - Mean temperature of all samples at 4 minutes
*3 minute MD, TD, Temp values used for this experiment.

These data show that, in general, the coatings of the two circular flakes, C-1 and C-2, produce substantially less variation in temperature when exposed to external E-field of a widely varying polarization angle than coatings of the two oblong flakes. As a result, the films coated with the circular flakes have superior temperature reproducibility.

Figure 2:
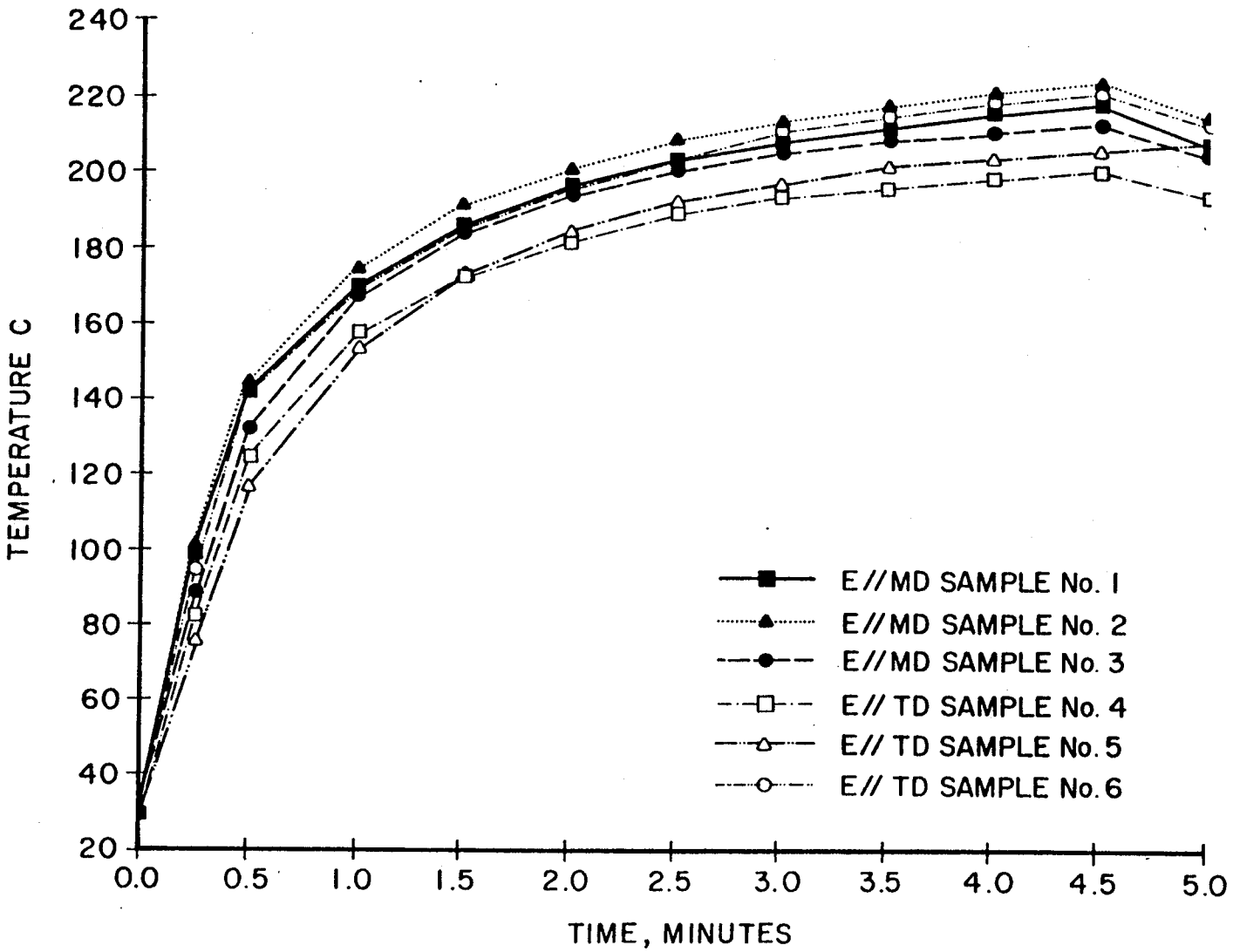
Figure 3:
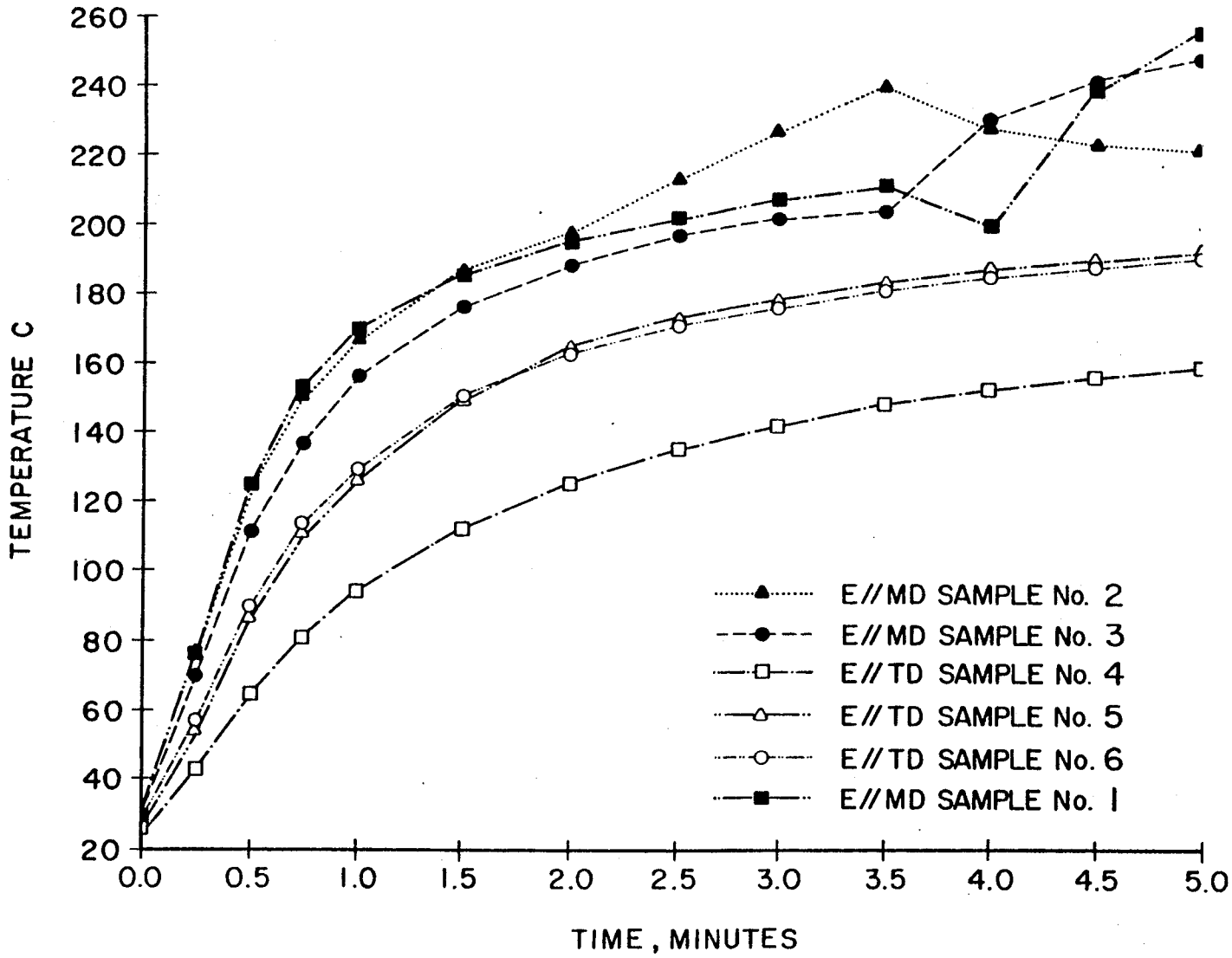

To compare data for films attaining temperatures above 190 degrees C after four minutes, one may review Examples 11, 12 and 25. FIGS. 1 and 2 graphically present the temperature data obtained for the films in respective Examples 11 and 12, both films coated with circular flakes which pass the Heating Performance Reproducibility Test. In contrast, FIG. 3 presents the temperature data for the film in Example 25, one coated with oblong flakes which failed the Heating Performance Reproducibility Test. Temperature vs. time data for each of the six pieces of film in each example are presented in the figures. "E//MD" indicates that the piece was heated in the microwave electric field with the electric field parallel to the machine direction of the film; "E//TD" indicates that the piece was oriented with the electric field parallel to the transverse direction of the film. The figures show that for the film of Example 25, in which an oblong aluminum flake material was used as susceptor material, the temperature of the six pieces after four minutes exposure to a microwave electric field of 243 V/cm varied by as much as 90 degrees C. By comparison, FIGS. 2 and 3 show that for the films of Examples 11 and 12, in which a circular aluminum flake material was used as susceptor material, the temperature of the six pieces after four minutes varied by no more than about 25 degrees C.

Examples 28–39

This set of examples show the improvement which can be obtained in the temperature reproducibility of a film coated with oblong flake susceptor material when the material is applied in a manner to produce a substantially isotropic coating. The susceptor material utilized in this example is a noncircular aluminum flake, designated "Reynolds LSB-548", available from Reynolds Aluminum Company, Louisville, KY. The matrix was prepared as in claim 1. Samples of PET film were hand-coated with the susceptor/matrix coating, the first coating being applied in the machine direction, the second coating being applied in the transverse direction, and subsequent coatings being applied alternately in the MD and the TD. Six pieces of each film sample were exposed to a microwave electric field of 243 V/cm for four minutes, three with the electric field parallel to MD, and the other three with the electric field parallel to TD. The average temperatures for each sample, $\overline{MD}$ and $\overline{TD}$, are presented in Table IX.

TABLE IX

| | # Coating Passes | | Dry Coating Thickness | Al in Dry Coating | | | |
|---|---|---|---|---|---|---|---|
| Ex | MD | TD | mils | % | g/m² | 4' MD | 4' TD |
| 28 | 4 | 0 | 1.3-1.5 | 20 | 10.0 | 79.2 | 55.7 |
| 29 | 5 | 0 | 1.6-1.7 | 20 | 11.8 | 104.2 | 71.7 |
| 30 | 6 | 0 | 1.7-1.9 | 20 | 12.9 | 99.7 | 95.3 |
| 31 | 8 | 0 | 2.4-2.5 | 20 | 17.5 | 133.5 | 121.6 |
| 32 | 2 | 2 | 1.4-1.6 | 20 | 10.7 | 98.9 | 90.0 |
| 33 | 3 | 2 | 2.3-3.1 | 20 | 19.3 | 147.4 | 154.0 |
| 34 | 3 | 3 | 2.5-2.8 | 20 | 19.0 | 157.8 | 159.7 |
| 35 | 4 | 4 | 3.3-3.4 | 20 | 24.0 | 162.3 | 160.2 |
| 36 | 1 | 0 | 0.2 | 40 | 3.3 | 46.7 | 56.3 |
| 37 | 1 | 1 | 0.6-0.7 | 40 | 10.7 | 128.7 | 131.3 |
| 38 | 2 | 2 | 1.4-1.7 | 40 | 25.5 | 162.0 | 167.7 |
| 39 | 4 | 4 | 2.4-2.7 | 40 | 42.0 | 157.0 | 154.7 |

These data show that by increasing the isotropy of the coating (by applying layer(s) in which the alignment of flakes is oriented about ninety degrees to the alignment of flakes in another layer(s), as in Examples 32-35 and 37-39), the temperature reproducibility of the coated film was improved.

What is claimed is:

1. A composite flexible packaging film material for controlled generation of heat by absorption of microwave energy so as to generate additional heat for food packaged by said film during transmission of said microwave energy by said film material during microwave cooking of said food, comprising (a) a dielectric substrate substantially transparent to microwave radiation, and (b) a coating on at least one surface of the substrate comprising (i) about 5 to 80% by weight of metal or metal alloy susceptor in flake form, and (ii) about 95 to 20% by weight of a thermoplastic dielectric matrix, said flakes being dispersed in said dielectric matrix so that they are substantially insulated from each other, wherein the surface weight of said coating on the substrate is in the range of about 2.5 to 100 g/m² D.C. surface resistance of the resulting composite material is at least $1\times10^6$ ohms per square.

2. A composite of claim 1 where the coating contains about 25 to 80% by weight of metal or metal alloy susceptor and about 75 to 20% by weight of a thermoplastic dielectric matrix.

3. A composite of claim 1 or 2 where the dielectric substrate is a polyester copolymer selected from the group consisting of copolymers of ethylene glycol, terephthalic acid and azelaic acid, copolymers of ethylene glycol, terephthalic acid and isophthalic acid, or mixtures of said copolymers.

4. A composite of claim 1 or 2 where the susceptor is aluminum.

5. A composite of claim 1 where the dielectric substrate is polyethylene terephthalate film, and the coating on at least one surface thereof comprises 30 to 60% by weight aluminum flake and 70 to 40% by weight of a copolymer of ethylene glycol with terephthalic acid and either isophthalic acid or azelaic acid or mixture of such copolymers.

6. A packaging material comprising a composite of claim 1 or 2 laminated to a second dielectric substrate substantially transparent to microwave radiation.

7. A packaging material of claim 6 where the second dielectric substrate is a polyester film or paper.

8. A composite of claim 1 or 2 capable of heating to a temperature of about 150° C. or higher when subjected to microwave energy of 550 watts at 2450 megahertz for a period of 120 seconds.

9. A composite of claim 1 or 2 capable of heating to a temperature of about 190° C. or higher when subjected to microwave energy of 550 watts at 2450 megahertz for a period of 120 seconds.

10. A composite of claim 1 where the susceptor comprises a circular flake having an ellipticity in the range of about 1:1 to 1:2.

11. A composite of claim 10 where the susceptor comprises an aluminum flake.

12. A composite of claim 11 where the susceptor comprises about 40 to 70 % by weight of the coating.

13. A composite of claim 1 where the susceptor comprises an oblong flake having an ellipticity greater than 1:2.

14. A composite of claim 13 where the susceptor comprises an aluminum flake.

15. A composite of claim 14 where the susceptor comprises about 20 to 60 % by weight of the coating.

16. A composite of claim 1 where the coating comprises at least two layers and the direction of alignment of susceptor flakes in at least one of said layers is oriented at about ninety degrees to the direction of alignment of susceptor flakes in at least one other of said layers.

17. A composite of claim 16 where the susceptor is an oblong flake having an ellipticity greater than 1:2.

18. A composite of claim 1, samples of which when exposed to a microwave electric field of 243 V/cm for four minutes, said electric field parallel to the longitudinal direction of the composite in half of said samples and said electric field parallel to the cross direction of the composite in half of said samples, meet the following requirements:

(1) $\overline{MD}$ and $\overline{TD}$ are each within $\overline{Temp}\pm5\%$;

(2) Each MD Temperature is within $\overline{MD}\pm10\%$, and (3) Each TD Temperature is within $\overline{TD}\pm10\%$, where MD Temperature is the temperature for any sample exposed with said electric field direction parallel to the longitudinal direction of the composite and $\overline{MD}$ is the mean temperature of all of such samples; TD Temperature is the temperature for any sample exposed with said electric field direction parallel to the cross direction of the composite and $\overline{TD}$ is the mean temperature of all of such samples; and $\overline{Temp}$ is the mean of all MD Temperatures and TD Temperatures, all temperatures being in Centigrade and measured after four minutes exposure to the microwave electric field.

19. A method for making a composite of claim 1 comprising applying a plurality of thin, dilute coats of a dispersion of susceptor and thermoplastic matrix in a suitable solvent to the dielectric substrate.

20. The method of claim 19 in which said thin, dilute coats are applied in a manner so that the direction of alignment of susceptor flakes in at least one said coat is oriented at about ninety degrees to the direction of alignment of susceptor flakes in at least one other of said coats.

21. A composite of claim 10, 13, 16 or 18 capable of heating to a temperature of about 150 degrees C. or higher when subjected to microwave energy of 550 watts at 2450 Mhz for a period of 120 seconds.

22. A composite of claim 10, 13, 16 or 18 capable of heating to a temperature of about 190 degrees C. or higher when subjected to microwave energy of 550 watts at 2450 Mhz for a period of 120 seconds.

23. In combination with food for microwave cooking, a flexible film packaging for said food incorporating composite film material for controlled generation of heat by absorption of microwave energy so as to generate additional heat for said food during transmission of said microwave energy by said composite film material for microwave cooking of said food, said composite film material comprising (a) a dielectric substrate substantially transparent to microwave radiation, and (b) a coating on at least one surface of the substrate comprising (i) about 5 to 80% by weight of metal or metal alloy susceptor in flake form, and (ii) about 95 to 20% by weight of a thermoplastic dielectric matrix, said flakes being dispersed in said dielectric matrix so that they are substantially insulated from each other, wherein the surface weight of said coating on the substrate is in the range of about 2.5 to 100 g/m$^2$.

24. In combination with food for microwave cooking, a composite flexible packaging film material for controlled generation of heat by absorption of microwave energy so as to generate additional heat for food packaged by said film during transmission of said microwave energy by said film material during microwave cooking of said food, comprising (a) a dielectric substrate substantially transparent to microwave radiation, and (b) a coating on at least one surface of the substrate comprising (i) about 5 to 80% by weight of metal or metal alloy susceptor in flake form, and (ii) about 95 to 20% by weight of a dielectric matrix, said flakes being dispersed in said dielectric matrix so that they are substantially insulated from each other, wherein the surface weight of said coating on the substrate is in the range of about 2.5 to 100 g/m$^2$.

25. A composite material for controlled generation of heat by absorption of microwave energy during transmission of said microwave energy, comprising (a) a dielectric substrate substantially transparent to microwave radiation, and (b) a coating on at least one surface of the substrate comprising (i) about 25 to 80% by weight of metal or metal alloy susceptor in flake form, and (ii) about 75 to 20% by weight of a dielectric matrix, said flakes being dispersed in said dielectric matrix so that they are substantially insulated from one another, wherein the surface weight of said coating on the substrate is in the range of about 2.5 to 100 g/m$^2$.

26. A composite of claim wherein said dielectric substrate is paper.

27. In the combination of claim 23 wherein said dielectric substrate is paper.

28. In the combination of claim 24 wherein said dielectric substrate is paper.

29. The composite of claim 25 wherein said dielectric substrate is paper.

* * * * *

UNITED STATES PATENT AND TRADEMARK OFFICE

CERTIFICATE OF CORRECTION

PATENT NO. :5,021,293

DATED :June 4, 1991

INVENTOR(S) :Hua-Feng Huang and Donald Edward Plorde

It is certified that error appears in the above-identified patent and that said Letters Patent is hereby corrected as shown below:

Column 17, line 50, after "100g/$m^2$" insert -- and the --.

Column 20, line 28, after "100g/$m^2$." insert -- and the D.C. surface resistance of the resulting composite material is at least 1 x $10^6$ ohms per square. --

Column 20, line 29, after "claim" insert -- 1 --.

Signed and Sealed this

Fifteenth Day of December, 1992

*Attest:*

DOUGLAS B. COMER

*Attesting Officer*

*Acting Commissioner of Patents and Trademarks*